US005791101A

United States Patent [19]

Wallace

[11] Patent Number: 5,791,101

[45] Date of Patent: Aug. 11, 1998

[54] STAIR SUPPORT ASSEMBLY

[75] Inventor: Brent L. Wallace, Burlington, Canada

[73] Assignee: Wallace Stairbridge Inc., Ontario, Canada

[21] Appl. No.: 661,873

[22] Filed: Jun. 11, 1996

[51] Int. Cl.[6] ..... E04F 11/025

[52] U.S. Cl. ..... 52/191; 52/182; 248/247

[58] Field of Search ..... 52/182, 188, 190, 52/191, 712, 715; 248/300, 247

[56] References Cited

U.S. PATENT DOCUMENTS

| | | | |
|---|---|---|---|
| 3,365,222 | 1/1968 | Polyak | 52/712 X |
| 4,015,687 | 4/1977 | Dean | 52/191 X |
| 4,635,416 | 1/1987 | Ayala | 52/188 |
| 4,709,520 | 12/1987 | Vochatzer | 52/191 |

*Primary Examiner*—Michael Safavi
*Attorney, Agent, or Firm*—R. Craig Armstrong

[57] ABSTRACT

A stair support device is provided for installation on the upper surface of an inclined stair stringer. The device is foldable from a sheet metal template so as to define right-triangular first and second spaced-apart vertical sidewalls, positionable with their hypotenii along the stringer, the sidewalls being joined by an integral horizontal stair support surface. Preferably, the device further includes at least one and preferably two generally right-triangular support webs extending downwardly from against the stair support surface, positionable with their hypotenii on the upper surface of the stringer, thereby serving a load-bearing function between the stair support surface and the stringer. Various fold-out tabs are provided, to facilitate securing the device to the stringer, the stair against the stair support surface, and if applicable, a riser or kickplate against a vertical face of the device.

5 Claims, 4 Drawing Sheets

STAIR SUPPORT ASSEMBLY

BACKGROUND OF THE INVENTION

This invention relates to the construction of staircases.

Conventional construction of staircases involves the use of 2×12 inch lumber which is then cut to shape by a skilled carpenter. Labor costs for the construction of conventional staircases is generally estimated to be in the range of about $20 per step. Conventional houses which employ 8-foot ceilings depend on 13 conventional wood steps, hand built. To build a conventional set of staircases a skilled carpenter is required usually for a period of 6 to 10 hours.

After forming the stringer by conventional means, less than 4 inches of load bearing material may remain in some places. For this reason such conventionally built staircases are often limited in length due to structural integrity concerns.

There are remanufactured products presently marketed that allow a builder or handyman to construct steps with precut stringers or web steps. These products are typically limited to 5 to 8 steps rather than the 13 that are necessary to reach from one floor of a house to the other. There are also other patents which show previous attempts at improvements in this area, including U.S. Pat. Nos. 2,724,466; 4,819,391; 4,866,894; and 5,293,722. The devices shown in these earlier patents do not provide all the advantages of the present invention, however.

SUMMARY OF THE INVENTION

In view of the above, it is an object of the invention to provide a device which results in a simple and inexpensive means for building a staircase.

In the invention, therefore, a stair support device is provided for installation on the upper surface of an inclined stair stringer. The device is foldable from a sheet metal template so as to define right-triangular first and second spaced-apart vertical sidewalls, positionable with their hypotenii along the stringer, the sidewalls being joined by an integral horizontal stair support surface. Preferably, the device further includes at least one and preferably two generally right-triangular support webs extending downwardly from against the stair support surface, positionable with their hypotenii on the upper surface of the stringer, thereby serving a load-bearing function between the stair support surface and the stringer. Various fold-out tabs are provided, to facilitate securing the device to the stringer, the stair against the stair support surface, and if applicable, a riser or kickplate against a vertical face of the device.

The invention is intended to be used by semi-skilled or unskilled laborers. By using the invention, a substantial portion of the cost of the stringer is saved, and hours can be cut from the normally-required construction time, thus greatly reducing labor costs.

Because the invention retains all of the material of the stringer, it is structurally superior for any given lumber size, thus permitting less waste or longer staircase runs for a given lumber size. For example, subject to verification by adequate testing, the staircase could conceivably be built using 2×6 lumber where 2×12 is presently used, with comparable strength. The invention thus allows the use of smaller lumber and therefore younger trees, protecting older growth forests.

Beyond the labor and material savings, the product is recyclable and environmentally friendly. The steel substrate of which the invention is constructed is recyclable using conventional technologies. The invention is also reusable. Because the invention is attached using wood screws it may be removed from one staircase and re-employed on another.

Additional details and advantages of the invention will be specifically described or will become apparent in the course of the following detailed description.

BRIEF DESCRIPTION OF THE DRAWINGS

The invention will now be described in greater detail with reference to the accompanying drawings by way of example only, in which.

DETAILED DESCRIPTION OF THE PREFERRED EMBODIMENT

Figure 1:
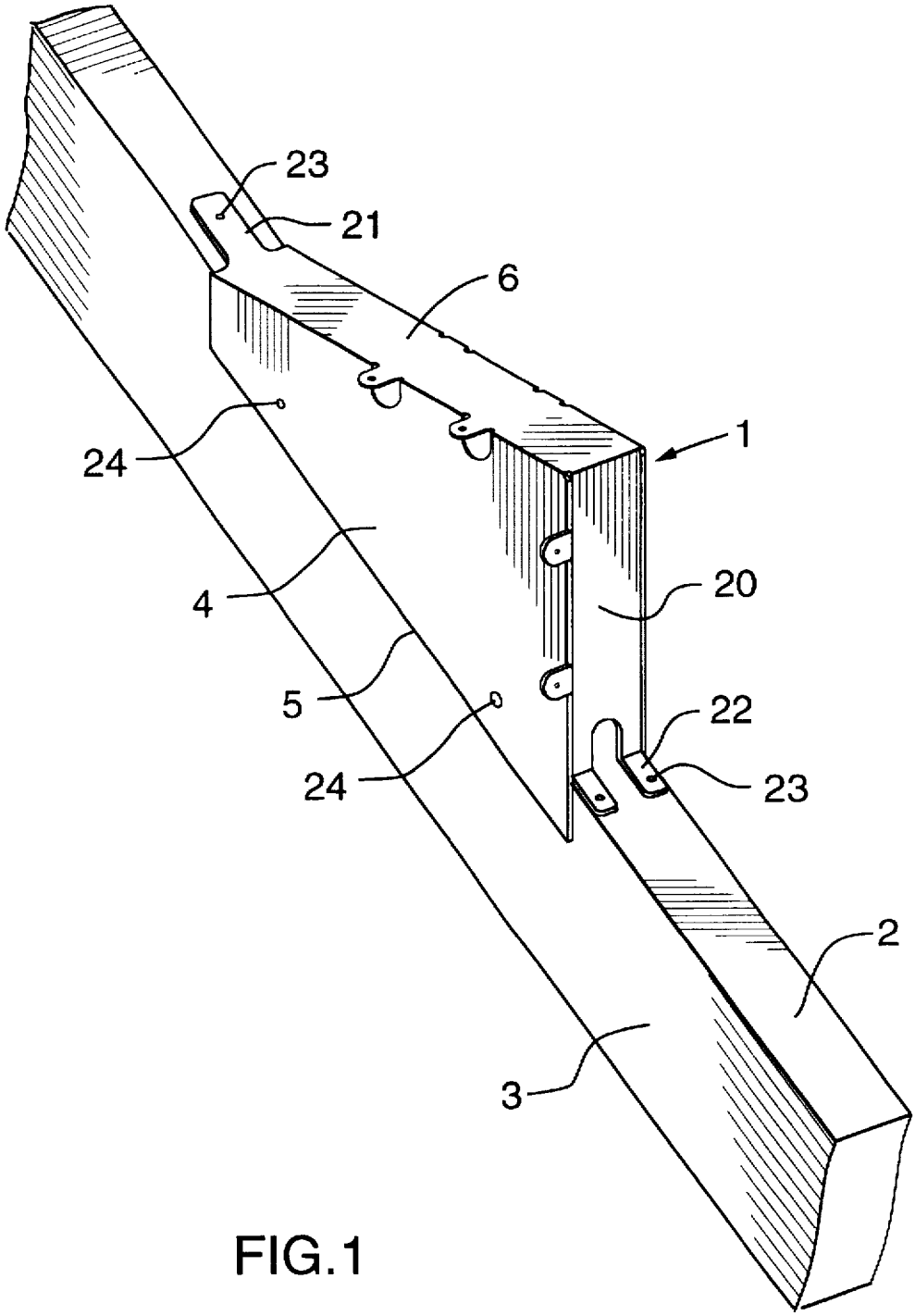
FIG. 1 is a perspective view of the device installed on a staircase stringer.
Figure 6:
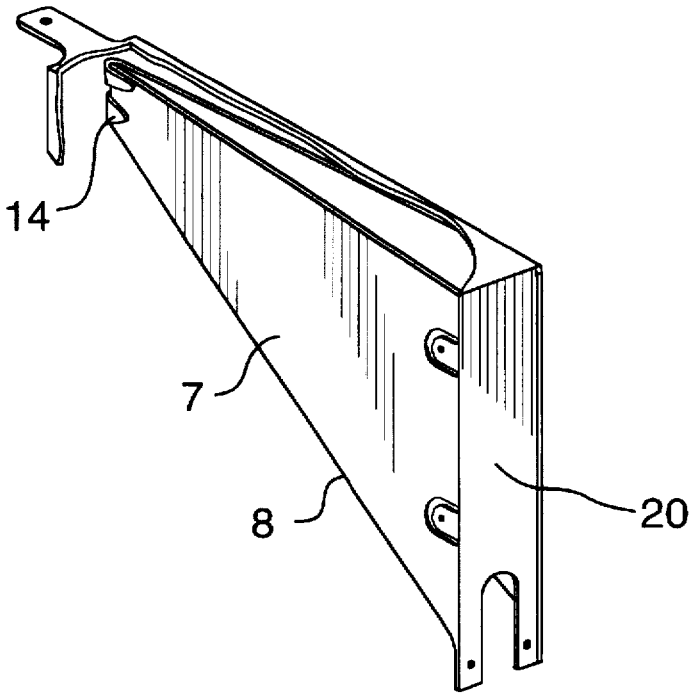
FIG. 6 is a perspective view of the device, cut away to show the internal support webs.
Figure 7:
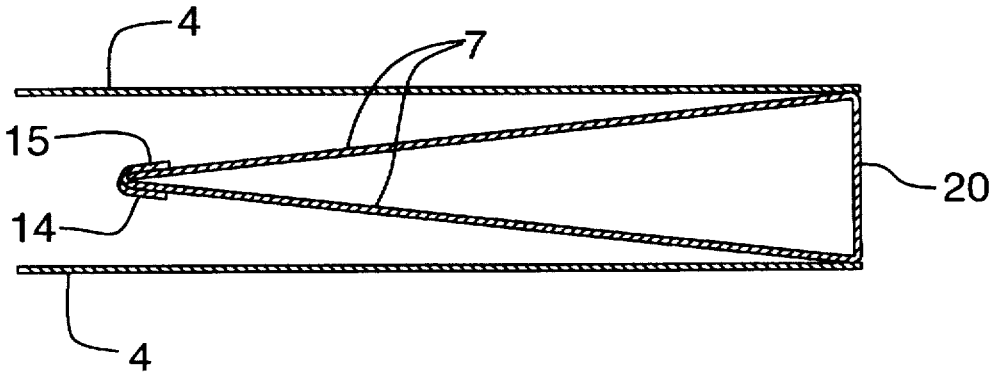
FIG. 7 is a top view of the device, in cross-section.

FIG. 1 shows the device 1 installed on the upper surface 2 of an inclined stair stringer 3. The device is foldable from a sheet metal "template", shown in FIG. 2, so as to define right-triangular first and second spaced-apart vertical sidewalls 4, positionable with their hypotenii 5 along the stringer, the sidewalls being joined by an integral horizontal stair support surface 6. Preferably, the device further includes at least one and preferably two generally right-triangular support webs 7, as seen in FIGS. 6 and 7, extending downwardly from against the stair support surface 6, positionable with their hypotenii 8 on the upper surface of the stringer, thereby serving a load-bearing function between the stair support surface and the stringer.

Figure 2:
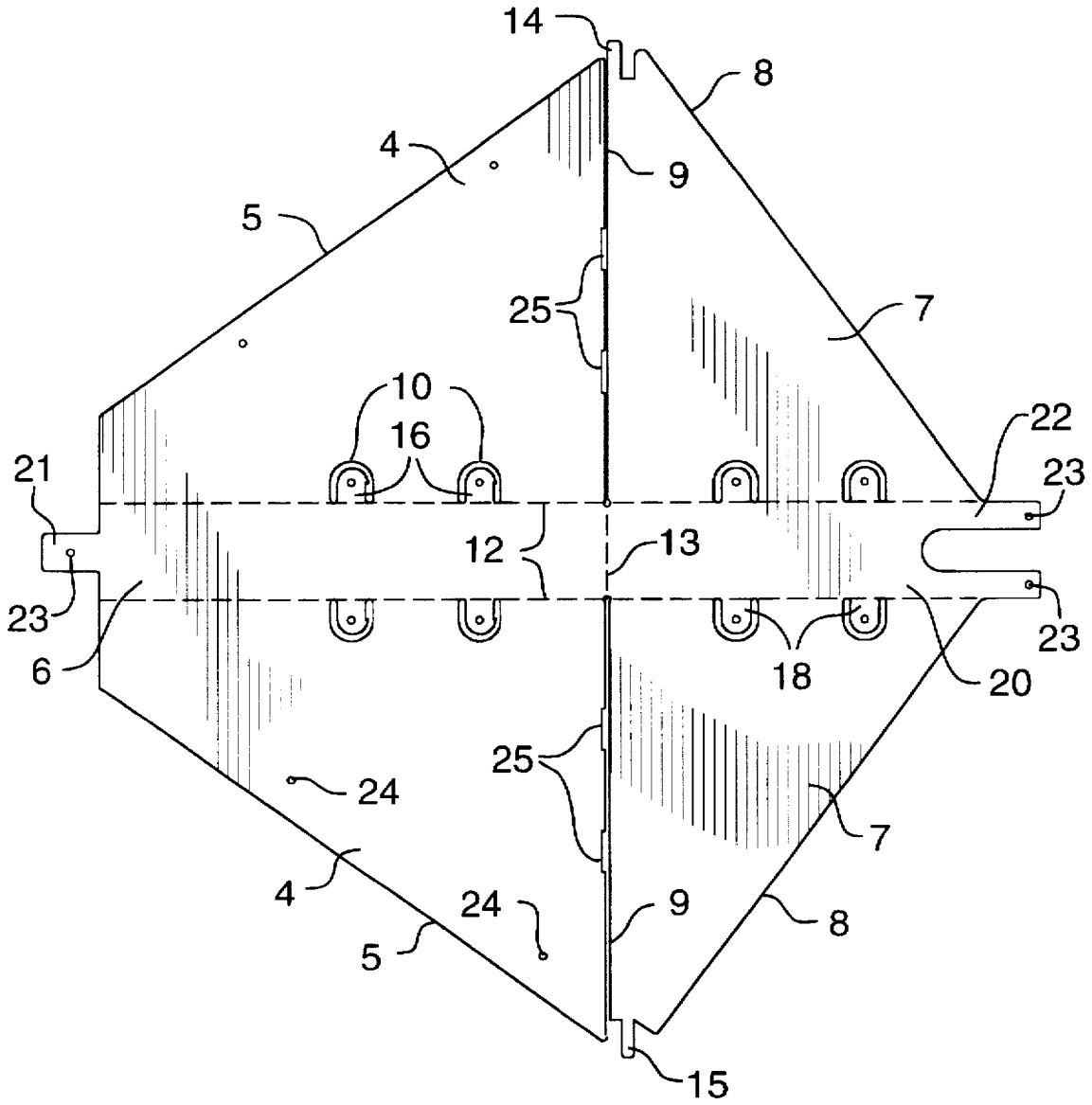
FIG. 2 is a plan view of the device in "template" or sheet metal form, after cutting and before folding.
Figure 4:
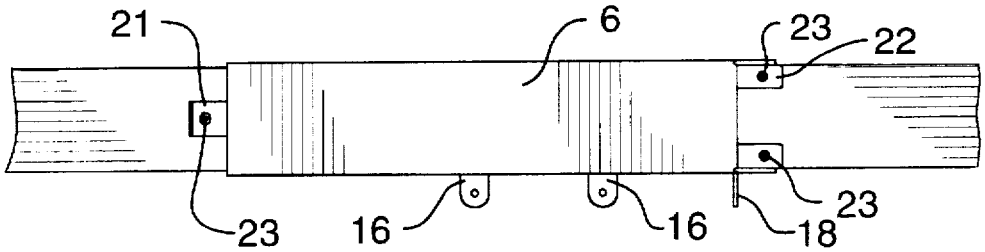
FIG. 4 is a top view of the device, installed on a stringer.
Figure 3:
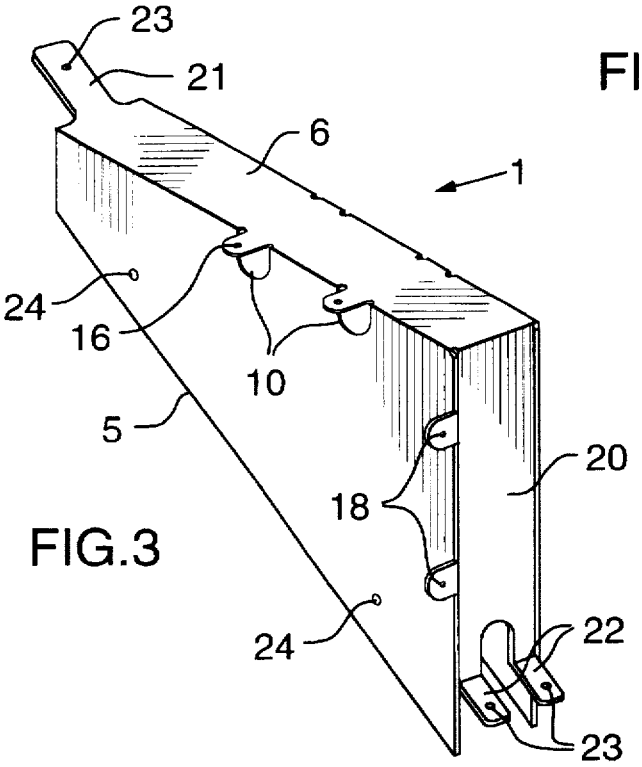
FIG. 3 is a perspective view of the device, similar to FIG. 1.
Figure 5:
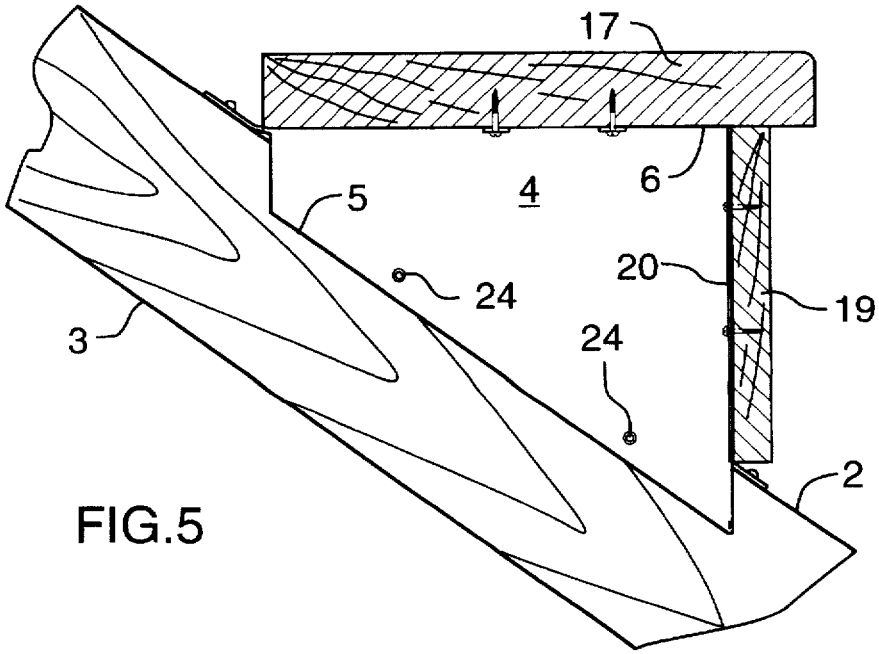
FIG. 5 is a side elevation view of the device, installed on a stringer, with the stair and riser or kickplate cross-section.

The template is formed by stamping, laser cutting, or otherwise manufacturing the shape shown in FIG. 2, including cut lines 9 and cuts 10 for various tabs as described below, from any suitable conventional sheet metal such as 0.028 inch galvinized substrate. The gauge or thickness of such sheet metal may be varied according to the manufacturer's preference, depending obviously on strength requirements for the intended applications. The actual metal and thickness of same are not considered to be material to the invention, and selection of same is of course within the ordinary skills of those who are knowledgeable in the field, once presented with the invention.

Once the shape is produced, it is folded into the shape of FIG. 1 by folding the support webs 7 towards each other and the sidewalls 4 towards each other, both along fold lines 12, and by folding the support webs into position between the sidewalls by folding along fold line 13. The support webs preferably are secured to each other at their distal ends, as best seen in FIG. 7, by folding over interlocking tabs 14 and 15.

Fold-out tabs 16 are provided for use in securing the stair 17 against the stair support surface 6, using wood screws or any other suitable fastening means. If the staircase is to be provided with risers or kickplates, then similar tabs 18 are provided for use in securing the riser or kickplate 19 against the vertical face 20 of the device, again using wood screws or any other suitable fastening means. The sidewalls 4 preferably but not essentially are provided with cutouts 25 to accommodate the tabs 18. If no kickplate is used, then the tabs 18 can be folded flush with the sidewalls, as shown in FIG. 6.

For the purpose of securing the device to the stringer, upper and lower tabs 21 and 22 are provided, each with holes 23 for wood screws or the like, and the sidewalls preferably extend slightly down the side of the stringer, and have holes 24 spaced therealong for wood screws or the like to extend sideways into the stringer.

It follows from the above that, since lumber of 2-inch nominal thickness is used, the fold lines 12 should be spaced apart by a matching distance.

It should be appreciated that the above detailed description relates to the preferred embodiment of the invention by way of example only. A number of variations could obviously be made while still embodying the substance of the invention, and such obvious variations are within the scope of the invention.

I claim:

1. A stair support device for supporting a stair on a stair stringer, comprising a sheet metal piece having:

an elongated rectangular portion having a stair support portion and a vertical face portion foldable at ninety degrees to each other along a fold line therebetween;

first and second generally right-triangular sidewall portions extending from opposite sides of said stair support portion, being foldable downwardly therefrom along fold lines between said sidewall portions and said stair support portion so as to define spaced-apart sidewalls; and first and second generally right-triangular support web portions extending from opposite sides of said vertical face portion, being foldable therefrom along fold lines between said web portions and said stair support portion so as to extend between said sidewalls;

the sidewall and web portions on same sides of said rectangular portion abutting each other but being separated from each other by cut lines.

2. A stair support device for installation on the upper surface of an inclined stair stringer, fastenable to said stringer, comprising a sheet metal piece having first and second right-triangular sidewall portions separated by an integral stair support surface, specifically configured so as to be foldable along two fold lines located one between each of said sidewall portions and said stair support surface so as to define right-triangular first and second spaced-apart vertical sidewalls, specifically configured to be positionable with their hypotenii along said stringer with said stair support surface running horizontally thereabove, where said sheet metal piece further has at least one generally right-triangular support web foldable along a fold line and specifically configured so as to extend downwardly from against said stair support surface and between said sidewall portions, so as to be positionable with its hypotenuse on said upper surface of said stringer, thereby serving a load-bearing function between said stair support surface and said stringer.

3. A stair support device as recited in claim 2, where there are two said support webs.

4. A stair support device as recited in claim 3, further comprising a vertical face piece integral with and foldable down from a front edge of said horizontal stair support surface at a fold line therebetween, where said two support webs are integral with and foldable from opposite side edges of said vertical face piece, along fold lines between said support webs and said vertical face piece.

5. A stair support device as recited in claim 4, where said support webs have distal ends opposite to and distal from said vertical face piece, said distal ends having means for connection to each other whereby said support webs define a V-shape as viewed from above.

* * * * *